US008203417B2

(12) United States Patent
Cordier et al.

(10) Patent No.: US 8,203,417 B2
(45) Date of Patent: Jun. 19, 2012

(54) INDUCTOR ASSEMBLY

(75) Inventors: Christophe Cordier, Caen (FR); Sebastien Jacquet, Caen (FR)

(73) Assignee: ST-Ericsson SA, Geneva (CH)

( * ) Notice: Subject to any disclaimer, the term of this patent is extended or adjusted under 35 U.S.C. 154(b) by 335 days.

(21) Appl. No.: 12/536,037

(22) Filed: Aug. 5, 2009

(65) Prior Publication Data

US 2010/0039092 A1 Feb. 18, 2010

(30) Foreign Application Priority Data

Aug. 5, 2008 (EP) ..... 08290751

(51) Int. Cl.
*H01F 5/00* (2006.01)

(52) U.S. Cl. ..... 336/200; 336/223; 323/363

(58) Field of Classification Search ..... 323/262, 323/207, 282–285, 355–358, 335; 363/16–20, 363/37, 46, 143, 56.1; 361/86, 91.1, 98; 336/147, 178, 180, 184, 198, 200, 212
See application file for complete search history.

(56) References Cited

U.S. PATENT DOCUMENTS

| | | | | |
|---|---|---|---|---|
| 4,873,757 | A * | 10/1989 | Williams | 29/602.1 |
| 5,610,433 | A * | 3/1997 | Merrill et al. | 257/531 |
| 5,621,287 | A * | 4/1997 | Dossot et al. | 315/399 |
| 6,479,976 | B1 * | 11/2002 | Edel | 323/357 |
| 6,661,325 | B2 * | 12/2003 | Suh et al. | 336/200 |
| 6,885,275 | B1 * | 4/2005 | Chang | 336/200 |
| 7,667,440 | B2 * | 2/2010 | Qiu et al. | 323/262 |
| 7,782,166 | B2 * | 8/2010 | Loke et al. | 336/200 |

FOREIGN PATENT DOCUMENTS

JP 6-290968 10/1994

* cited by examiner

*Primary Examiner* — Rajnikant Patel
(74) *Attorney, Agent, or Firm* — Potomac Patent Group PLLC

(57) ABSTRACT

An inductor assembly includes a first inductor, a second inductor being magnetically coupled to the first inductor, and a third inductor being magnetically coupled to said first and second inductors. The third inductor may be connected to a variable resistor adapted for adjusting the magnetic coupling between the first and the second inductors by varying a resistance value of said variable resistor.

18 Claims, 3 Drawing Sheets

INDUCTOR ASSEMBLY

BACKGROUND

1. Technical Field

The present disclosure refers to an inductor assembly, and more specifically to an inductor winding assembly of a transformer having a plurality of inductors.

2. Description of the Related Art

Reference JP 06-290968 discloses a winding or inductor assembly of a printed coil type transformer including a plurality of windings. The printed coil type transformer specifically includes a primary winding and a secondary winding being magnetically coupled to each other and forming a voltage transformer. Each coil is provided as a printed inductor pattern, and one terminal of each inductor pattern is grounded. In addition to the primary and secondary windings, a third winding is provided in which the transformer polarity coincides with that of the secondary winding. The third winding also has one terminal grounded. A corresponding inductor pattern layer of the third winding is arranged oppositely to an inductor pattern layer nearest to the primary winding and the secondary winding. Specifically, the voltage of the third winding is generated by an AC voltage applied to the primary winding, and the voltage of the secondary winding is generated by an AC voltage induced in the secondary winding approximately agree. The third winding arranged between the primary and secondary winding provides a shielding effect of the primary and secondary windings.

According to the arrangement as disclosed in the above reference, besides the shielding effect between the primary and secondary coils it is difficult to obtain a controlled influence on the induction in the respective coils.

BRIEF SUMMARY

One embodiment is an inductor assembly which allows adjustment of an inductive coupling between predetermined inductors.

One embodiment is a winding assembly as put forward in the appended claims.

One inductor assembly of a transformer according to the present disclosure comprises a first inductor, a second inductor being magnetically coupled to the first inductor, and a third inductor being magnetically coupled to the first and second inductors, wherein the third inductor being connected to a variable resistor adapted for adjusting the magnetic coupling between the first and the second inductors by varying a resistance value of the variable resistor.

Hence, according to the present disclosure, the inductor assembly of the transformer including the first (primary) inductor and the second (secondary) inductor includes the third (tertiary) inductor which allows a specific operation thereof in that the magnetic coupling between the primary inductor and the secondary inductor can be influenced by the third inductor. This is specifically performed by modifying the resistance value of a variable resistor which is connected to the third inductor. The third inductor in conjunction with the variable resistor constitutes a variable attenuator inside the transformer (voltage transformer) having the inductor assembly. The variable attenuator dissipates some power of the inductor assembly in the third inductor, thereby introducing losses inside the voltage transformer. The attenuation can be obtained and can be set in a precise manner by directly varying the resistance value of the variable resistor. Hence, the cooperation of the primary and secondary inductors and specifically the magnetic coupling thereof can easily be adapted.

Embodiments of the present disclosure are defined in the dependent claims.

The at least the first, second or third inductor may be formed as spiral windings. The first inductor and the second inductor form a transformer.

The third inductor may be arranged adjacent to at least one of the first and second inductors, and at least one of the first to third inductors may be formed by using semiconductor and/or printed board technologies.

The variable resistor may he adapted for adjusting the magnetic coupling by adjusting a current induced in the third inductor.

The induced current may cause a power dissipation in the variable resistor, the variable resistor and the third inductor constituting an attenuator of the magnetic coupling between the first and second inductors.

The inductor assembly may further include a fourth inductor being magnetically coupled to the at least first and second inductors, and the fourth inductor being connected to a further variable resistor adapted for adjusting the magnetic coupling between at least the first and the second inductors by varying a resistance value of the further variable resistor.

The first to fourth inductors may be flat disc-shaped windings.

The fourth inductor may be arranged adjacent to at least one of the first and second inductors, the third inductor and the fourth inductor being arranged on different sides of the at least one of the first and second inductors.

The third inductor being magnetically coupled to the first and second inductors by at least a part of the magnetic field generated by the first inductor.

The fourth inductor may be magnetically coupled to the first and second inductors by at least a part of the magnetic field generated by the first inductor.

The fourth inductor may be provided in the form of spiral windings.

The first to fourth inductors may be formed based on semiconductor and/or printed board technologies, and may be arranged in different layers stacked according to a predetermined sequence.

The present disclosure is further elucidated by the following Figures and examples, which are not intended to limit the scope of the disclosure. The person skilled in the art will understand that various embodiments may be combined.

BRIEF DESCRIPTION OF THE SEVERAL VIEWS OF THE DRAWINGS

These and other aspects of the disclosure will be apparent from and elucidated with reference to the embodiments described hereinafter. In the following drawings.

DETAILED DESCRIPTION

Figure 1:
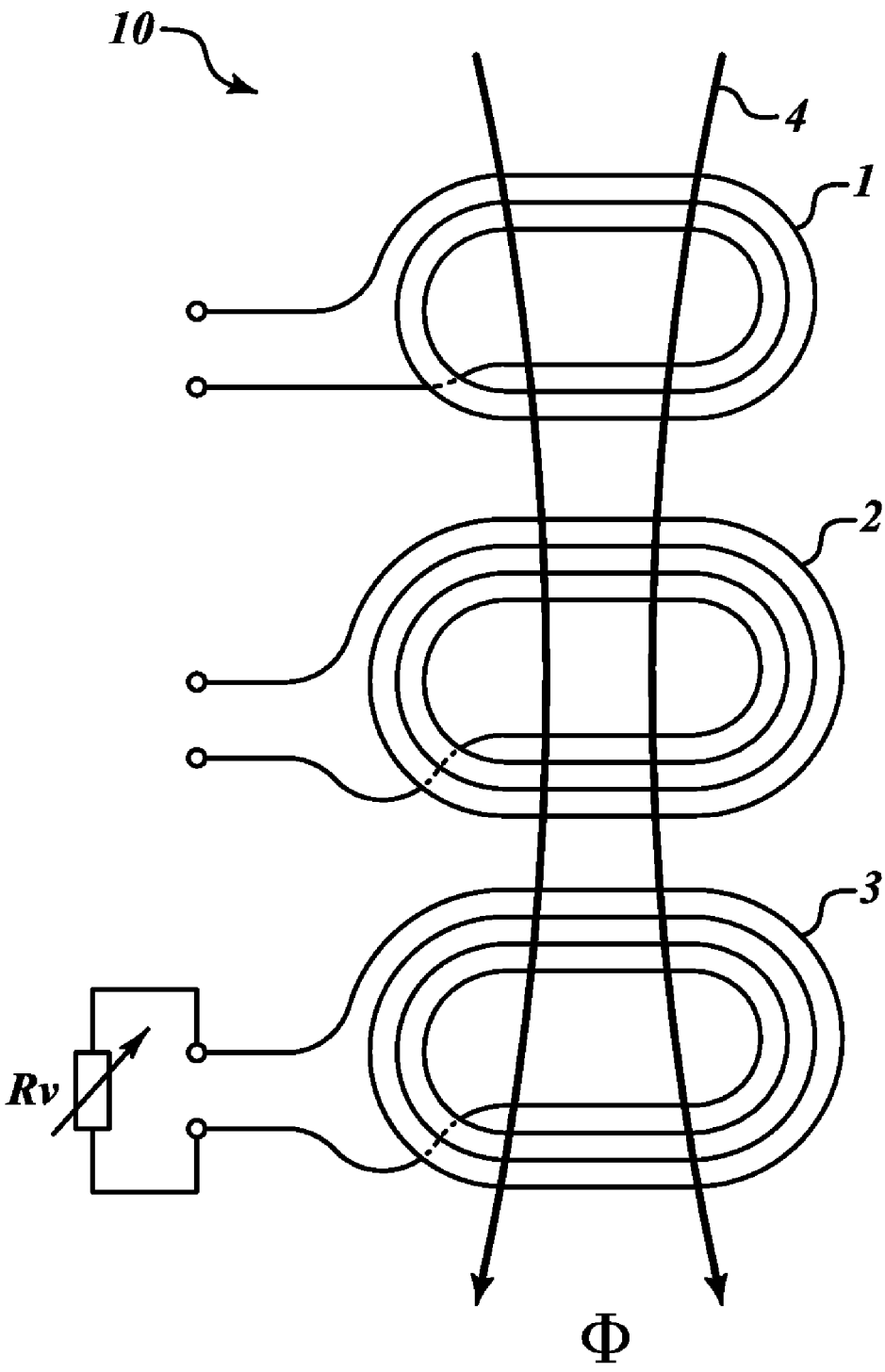
FIG. 1 shows a schematic overview of an inductor assembly according to one embodiment of the present disclosure.

According to the basic arrangement shown in FIG. 1, an inductor assembly 10 of a transformer (voltage transformer)

includes a first inductor 1 which constitutes the primary winding or primary coil. A second inductor 2 is provided in close spatial relationship to the first inductor 1 and constitutes the secondary winding or secondary coil of the transformer. In addition to the first and second inductors 1 and 2, a third inductor 3 may be arranged also in close spatial relationship to the first and second inductors 1 and 2.

The arrangement of the first to third inductors (primary to tertiary windings or coils) constitutes the inductor assembly 10 wherein each of the first to third inductors 1 to 3 is electromagnetically coupled to a common magnetic field 4 via induction. The common magnetic field 4, as shown in FIG. 1 and further indicated by Φ representing magnetic flux, penetrates each of the first to third inductors 1 to 3 and therefore provides a magnetic coupling of each of the plurality of inductors 1 to 3 with the respective other inductors.

Accordingly, due to the magnetic coupling of the first inductor 1 to the second inductor 2, a voltage applied to the first inductor 1 will cause a corresponding current and will further cause, via change over time in the magnetic flux Φ of the magnetic field 4 (magnetic flux Φ) an induction voltage in the second inductor 2 (secondary winding). In case the second inductor 2 is connected to any circuitry at its terminals (forming a load to the second inductor 2), a corresponding current will flow to the circuitry connected thereto.

As mentioned above and as depicted in FIG. 1 the first and second inductors (primary and secondary windings) 1 and 2 have an inductive coupling, i.e., are coupled by the rate of change of the magnetic flux Φ of the magnetic field 4. This allows in a corresponding manner the transmission of power from the first inductor 1 to the second inductor 2, and in a corresponding manner from the primary winding to the secondary winding of the transformer.

As is further depicted in FIG. 1, also the third inductor 3 (tertiary winding or coil) may be arranged in such a manner relative to the first and second inductors 1 and 2, that the magnetic field basically driven by the first inductor 1 (primary winding) also penetrates the third inductor 3. Hence, the third inductor 3 is magnetically coupled to the first and second inductors 1 and 2 so that the same magnetic field (basically derived front the first inductor 1) provides a magnetic coupling of all of the plurality of inductors 1 to 3. That is, all three inductors 1 to 3 are magnetically coupled by the same magnetic field 4 (Φ) according to the principles of magnetic induction, and specifically the third inductor 3 may be arranged adjacent to at least one of the first and second inductors 1 and 2.

Figure 2:
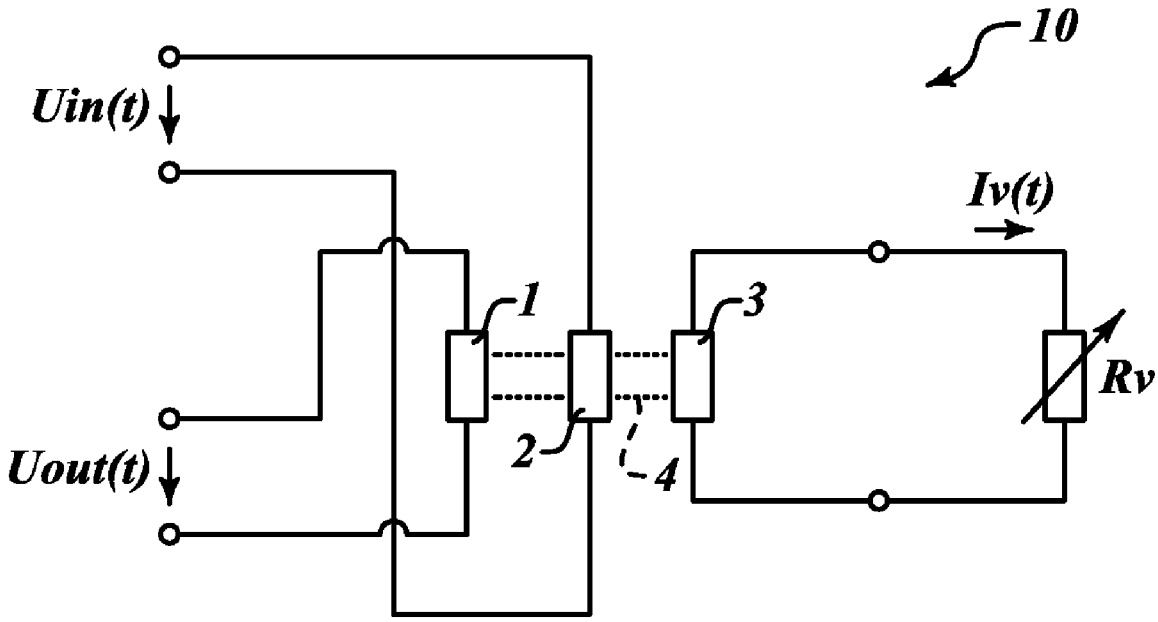
FIG. 2 shows the basic circuitry in conjunction with the inductor assembly of FIG. 1 according to one embodiment of the present disclosure.

FIG. 2 shows from another point of view the arrangement of the plural inductors 1 to 3 and possible connections of these inductors. The first inductor 1 forming the primary winding is supplied with an input voltage Uin(t) which will then cause a current flowing through the first inductor 1 and will further establish the magnetic field 4. Typically, the input voltage Uin(t) varies in time, e.g., the input voltage Uin(t) may be a pulse, or pulse train, or sinusoidal, ramp, saw-tooth, etc.

The second inductor 2 with its inductive coupling to the first inductor 1 generates due to the induction principles an output voltage Uout(t) which will cause an output current if a corresponding circuitry is connected to the second inductor 2. According to the regular principles of a transformer power can be transmitted from the primary side (inductor 1) to the secondary side (inductor 2). The input voltage Uin(t) and the output voltage Uout(t) are time-variable physical parameters.

As is also depicted in FIG. 1, the third inductor 3 (tertiary winding) may be connected to a resistor Rv. This resistor Rv may be provided in the form of a variable resistor the resistance value thereof can be varied within a predetermined range.

Based on the induction principles a current Iv(t) is induced in the circuit composed of the third inductor 3 and the resistor Rv. The Current Iv(t) (which is a time-variable physical parameter) flowing in this circuit is dependent upon the resistance value of the resistor Rv. That is, the value of the current Iv(t) through the third inductor 3 and the resistor Rv can be modified and, thus, adjusted by adjusting the resistance value of the resistor Rv. The circuit including the third inductor 3 and the (variable) resistor Rv constitutes an attenuator the function of which will be described in the following.

The current Iv(t) is induced in the third inductor 3 due to the magnetic coupling to the first and second inductors 1 and 2. That is, the third inductor 3 collects at least a part of the electromagnetic field penetrating the first and second inductors 1 and 2. The at least part of the magnetic field 4 is transformed by the third inductor 3 into the current Iv(t) which is further dependent upon the resistance value of the resistance Rv. The current Iv(t) flowing through the resistor Rv generates heat in the resistor Rv so that the placement of the resistor in the current path of this circuit makes it possible to dissipate some power which is received by the magnetic coupling from the magnetic field 4 of the first and second inductors 1 and 2. The power dissipated in the resistor Rv due to the induced current Iv(t) in the circuit is equivalent to induced losses inside the voltage transformer. That is, the dissipated power in the resistor Rv corresponds to voltage transformer losses.

In case a fixed resistance value of the resistor Rv is established, a predetermined power can be dissipated by the resistor Rv depending upon the magnetic field of the first and second inductors 1 and 2 and penetrating the third inductor 3. In case the resistor Rv is provided in the form of the variable resistor with an adjustable resistance value, this allows further influence on and control of the current Iv(t) flowing in the circuit of the third inductor 3 and the resistor Rv.

When picking up power supplied to the third inductor 3 by the magnetic coupling (magnetic field 4) the operation of the third inductor 3 corresponds to the attenuator of the voltage transformer. That is, when the (variable) resistor Rv is set to different resistance values within a predetermined range then different levels of power can be picked-up from the magnetic field 4 (magnetic flux Φ) penetrating the third inductor 3 for dissipation by the resistor Rv, thereby attenuating the magnetic field 4 coupling all three inductors 1 to 3 to obtain the desired attenuation effect. Accordingly, the inductive coupling between the first and second inductors 1 and 2 (between the primary and secondary windings) can be adjusted by adjusting the resistance value of the (variable) resistor Rv connected across the terminals of the third inductor 3.

Regarding the arrangement of the plurality of inductors 1 to 3 in one embodiment, the inductor assembly 10 of the voltage transformer is basically constituted by the first and second inductors 1 and 2 (primary and secondary windings), where at least one of the first and second inductors 1 and 2 is preferably made of spiral inductors placed close to each other, so that these two inductors 1 and 2 are substantially placed face to face. Preferably, at least the first and second inductors 1 and 2 are arranged in a flat manner and may basically be disc-shaped. This also holds for the third inductor 3, so that the first to third inductors 1 to 3 can be placed in close connection to each other to have a good magnetic coupling between these inductors. Basically, at least the first, second or third inductor 1 to 3 may be formed as spiral windings.

With the third inductor 3 being located closely related and preferably adjacent to the inductor assembly 10 of the voltage transformer comprising the first and second inductors 1 and 2, an optimized influence on the magnetic field 4 penetrating the plurality of inductors 1 to 3 can be obtained, resulting in a variable attenuation of the magnetic field 4 depending upon the set resistance value of the (variable) resistor Rv connected to the third inductor 3.

It is mentioned above that the third inductor 3 is arranged adjacent or proximate the voltage transformer, and specifically approximate to the second inductor 2 (secondary winding).

According to a further embodiment of the present disclosure, the third inductor 3 can also be arranged between the first and second inductors 1 and 2 or can be arranged proximate to the first inductor (primary winding) 1 while ensuring the same attenuation effect as described above. In both further cases and alternatively to the specific arrangement shown in FIG. 1, an electromagnetic coupling is ensured and the variable attenuation of the magnetic coupling between the first and second inductors 1 and 2 is in a similar manner obtained by changing the resistance value of the resistor Rv.

According to one embodiment the first to third inductors 1 to 3 are made of spiral windings or inductors. The present disclosure is, however, not limited to such an arrangement, and the plurality of inductors 1 to 3 may also be provided in the form of inductors having a square shape or any other suitable flat shape which allows an arrangement of the plurality of inductors 1 to 3 close to each other for ensuring a suitable magnetic coupling.

According to one embodiment the first to third inductors 1 to 3 each define a respective open surface. The respective open surfaces may be generally flat or planar. The respective open surfaces may be arranged relative to each other in a stack or may be generally parallel to each other.

The windings of the first to third inductors may be provided in the form of discrete wires or may be arranged on the basis of technologies of semiconductors and printed boards (irrespective of whether the inductor assembly being arranged in a package or not). Preferably, the windings of the inductors 1 to 3 are formed using semiconductor and/or printed board technologies. The inductor assembly 10 can be provided in a compact manner.

Figure 3:
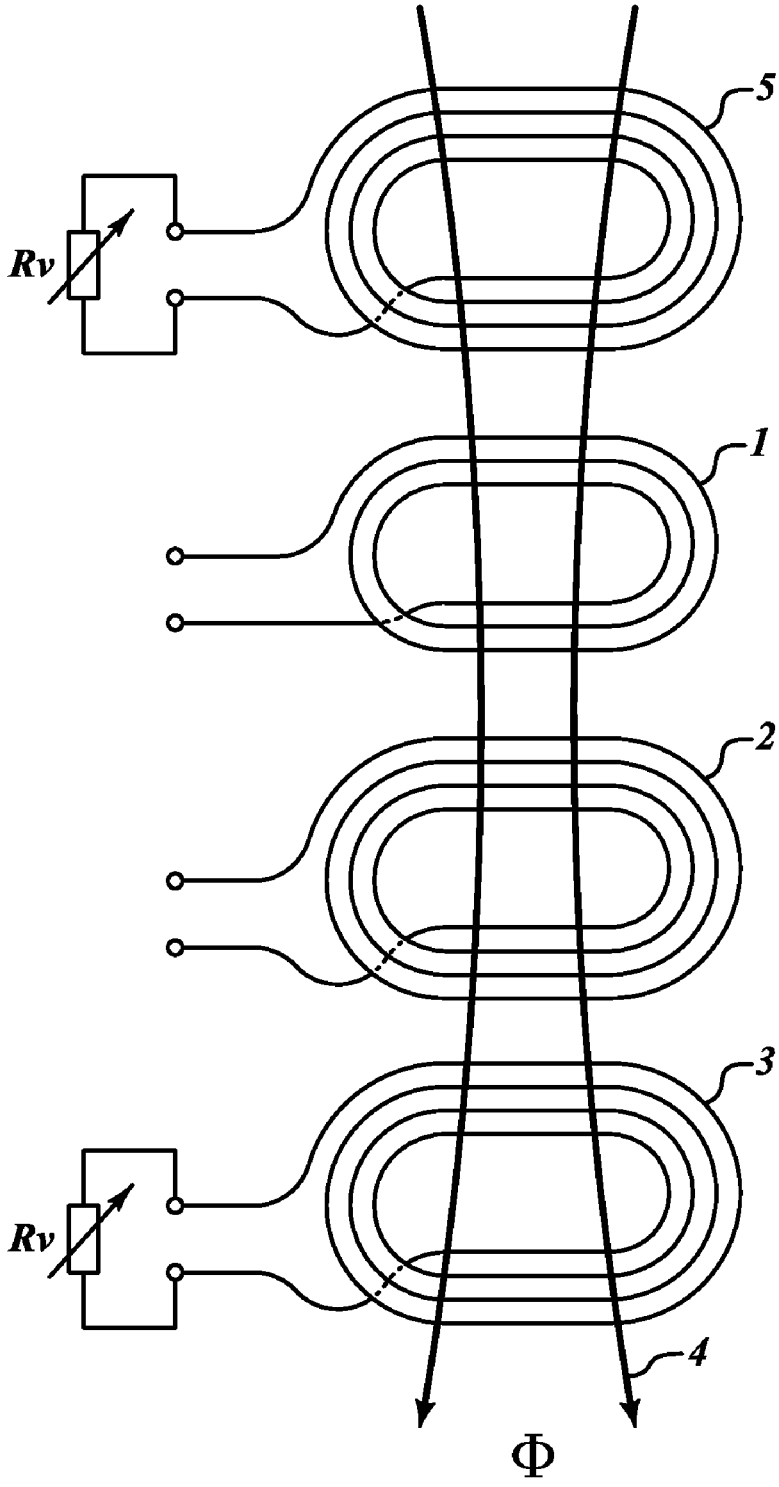
FIG. 3 shows a schematic overview of an inductor assembly according to another embodiment of the present disclosure.

According to a further alternative embodiment, in addition to the inductor arrangement (inductor assembly) shown in FIG. 1, a fourth inductor may be provided, located adjacent to one of the inductors 1 and 2 of the voltage transformer. As shown in FIG. 3, the additional fourth inductor 5 may also be connected to a resistor (Rv) having a fixed resistance value or to a variable resistor the resistance value of which can be set depending upon predetermined conditions.

In the embodiment of FIG. 3, the fourth inductor 5 may be arranged in a manner corresponding to the third inductor 3. The third inductor 3 may be placed for optimal magnetic coupling close (close, adjacent) to the other inductors 1 and 2 so that the control concept according to the present disclosure can be obtained and the attenuation effect on the magnetic coupling as described above can be established preferably in conjunction with the variable resistor. Similar to the third inductor 3, the fourth inductor 4 may be placed for optimal magnetic coupling close to the other inductors 1 and 2. Typically, in the fourth inductor 4 may be arranged such that the whole magnetic field 4 or at least a part thereof penetrates the fourth inductor 4.

Moreover; the first to fourth inductors which may be formed based on semiconductor and/or printed board technologies, may further be arranged in different layers stacked according to a predetermined sequence. Furthermore, the third inductor 3 and said fourth inductor 4 may be arranged on different sides of the at least one of the first and second inductors 1 or 2.

A variable attenuator inside the above-described voltage transformer (first and second inductors 1 and 2) provides an efficient measure to obtain a specific influence on the magnetic field 4 of the voltage transformer and, thus, on the magnetic coupling between the first and second inductors 1 and 2 (primary and secondary windings of the voltage transformer) by means of the variable resistor Rv. The variable attenuator, as described above, is highly effective in terms of noise and linearity in comparison to any arrangements using active components. The inductor assembly 10 and specifically the voltage transformer according to the present disclosure having introduced the variable attenuator inside the voltage transformer and is applicable for frequencies allowing the use of preferably spiral inductors with reasonable sizes which can be made based on the semiconductor and/or printed board technologies.

The attenuation of the magnetic field 4 is obtained by dissipating some power of the inductor assembly in the third inductor, thereby introducing losses inside the voltage transformer in a controlled or controllable manner and weakening the magnetic field 4. The attenuation can be set in a precise manner by directly varying the resistance value of the variable resistor Rv. Hence, the cooperation (functional connection by the magnetic field 4) of the primary and secondary inductors and specifically the magnetic coupling thereof can easily and precisely be adapted.

While the disclosure has been illustrated and described in detail in the drawings and foregoing description, such illustration and description are to be considered illustrative or exemplary and not restrictive; the disclosure is not limited to the disclosed embodiments.

Other variations to the disclosed embodiments can be understood and effected by those skilled in the art in practicing the claimed disclosure, from a study of the drawings, the disclosure, and the appended claims.

In the claims, the word "comprising" does not exclude other elements or steps, and the indefinite article "a" or "an" does not exclude a plurality. Any reference signs in the claims should not be construed as limiting the scope.

The invention claimed is:

1. An inductor assembly, comprising:

a first inductor, a second inductor magnetically coupled to the first inductor, a third inductor magnetically coupled to said first and second inductors, a first variable resistor coupled to the third inductor and configured to adjust the magnetic coupling between the first and the second inductors by varying a resistance value of said first variable resistor, a fourth inductor magnetically coupled to said first, second and third inductors, and a second variable resistor electrically coupled to the fourth inductor and configured to adjust the magnetic coupling between the first and second inductors by varying a resistance value of said second variable resistor.

2. The inductor assembly of claim 1, wherein at least the first, second or third inductors are spiral windings.

3. The inductor assembly of claim 1, wherein said first inductor and said second inductor constitute a transformer.

4. The inductor assembly of claim 1, wherein said third inductor is arranged adjacent to at least one of the first and second inductors.

5. The inductor assembly of claim 1, wherein at least one of said first to third inductors is formed by using semiconductor and/or printed board technologies.

6. The inductor assembly of claim 1, wherein said first variable resistor is configured to adjust the magnetic coupling by adjusting a current induced in said third inductor.

7. The inductor assembly of claim 6, wherein said induced current causes a power dissipation in said first variable resistor, said first variable resistor and said third inductor constituting an attenuator of the magnetic coupling between said first and second inductors.

8. The inductor assembly of claim 1, wherein said first to fourth inductors are flat disc-shaped windings.

9. The inductor assembly of claim 1, wherein said fourth inductor is arranged adjacent to at least one of the first and second inductors, said third inductor and said fourth inductor being arranged on different sides of the at least one of the first and second inductors.

10. The inductor assembly of claim 1, wherein said fourth inductor is magnetically coupled to said first and second inductors by at least a part of a magnetic field generated by said first inductor.

11. The inductor assembly of claim 1, wherein said fourth inductor includes a spiral winding.

12. The inductor assembly of claim 1, wherein said first to fourth inductors are formed based on semiconductor and/or printed board technologies, and are arranged in different layers stacked according to a predetermined sequence.

13. The inductor assembly of claim 1, wherein said third inductor is magnetically coupled to said first and second inductors by at least a part of a magnetic field generated by said first inductor.

14. An inductor assembly for use in a transformer, comprising:

a first inductor;

a second inductor arranged to be magnetically coupled to the first inductor by a magnetic field driven by the first inductor;

a first variable attenuator including:

a third inductor arranged to be magnetically coupled to said first and second inductors by the magnetic field, and a first variable resistor serially connected to the third inductor, the first variable resistor being configured to adjust the magnetic coupling between the first and the second inductors by varying a resistance value of the first variable resistor and a second variable attenuator including:

a fourth inductor magnetically coupled to said first, second and third inductors by the magnetic field, and a second variable resistor serially connected to the fourth inductor, the second variable resistor being configured to adjust the magnetic coupling between the first and the second inductors by varying a resistance value of the second variable resistor.

15. The inductor assembly of claim 14 wherein at least the first, second or third inductors are spiral windings.

16. The inductor assembly of claim 14 wherein said first inductor and said second inductor constitute a transformer.

17. The inductor assembly of claim 14 wherein said first, second, third and fourth inductors are generally planar disc-shaped windings that are generally aligned and arranged as a stack.

18. The inductor assembly of claim 17 wherein at least one of said first and second inductors generally interpose said third and fourth inductors.

* * * * *